US008783802B2

(12) United States Patent
Shmuel et al.

(10) Patent No.: US 8,783,802 B2
(45) Date of Patent: Jul. 22, 2014

(54) INTERMEDIATE FLUID SUPPLY APPARATUS HAVING FLEXIBLE MEMBRANE

(75) Inventors: David Shmuel, Tel-Aviv (IL); Yehuda Ben Abu, Netanya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 218 days.

(21) Appl. No.: 13/203,722

(22) PCT Filed: Feb. 28, 2009

(86) PCT No.: PCT/US2009/035612

§ 371 (c)(1), (2), (4) Date: Aug. 27, 2011

(87) PCT Pub. No.: WO2010/098775

PCT Pub. Date: Sep. 2, 2010

(65) Prior Publication Data

US 2011/0310143 A1 Dec. 22, 2011

(51) Int. Cl.
*B41J 2/195* (2006.01)

(52) U.S. Cl.
USPC ..... 347/7; 347/84; 347/19

(58) Field of Classification Search
USPC ..... 347/5, 6, 7, 14, 17, 19, 84–87
See application file for complete search history.

(56) References Cited

U.S. PATENT DOCUMENTS

| | | | | |
|---|---|---|---|---|
| 4,342,042 | A | 7/1982 | Cruz-Uribe et al. | |
| 4,475,116 | A | 10/1984 | Sicking et al. | |
| 6,786,580 | B1 | 9/2004 | Gray et al. | |
| 6,908,179 | B2 | 6/2005 | Pan et al. | |
| 7,004,574 | B2 | 2/2006 | Neese et al. | |
| 7,325,892 | B2 | 2/2008 | Nishihara | |
| 7,370,923 | B2 * | 5/2008 | Tanno et al. | 347/7 |
| 2004/0257413 | A1 | 12/2004 | Anderson, Jr. et al. | |
| 2006/0007254 | A1 | 1/2006 | Tanno et al. | |

FOREIGN PATENT DOCUMENTS

| | | | |
|---|---|---|---|
| EP | 1961575 | A2 | 8/2008 |
| JP | 2002-052731 | A | 2/2002 |
| WO | 8910265 | A2 | 11/1989 |
| WO | 9936895 | A1 | 7/1999 |
| WO | 0068018 | A1 | 11/2000 |

OTHER PUBLICATIONS

PCT ISR and WO in counterpart PCT patent application PCT/US2009/035612, dated Aug. 28, 2009.

* cited by examiner

*Primary Examiner* — Juanita D Jackson

(57) ABSTRACT

An intermediately fluid supply apparatus is to fluidically couple a primary fluid supply to one or more fluid-ejection printheads. A reservoir of the apparatus has a bottom surface and a number of side surfaces, and is open at the top of the reservoir. The reservoir is to store fluid supplied by the primary fluid supply, for ejection by the fluid-ejection printheads. A flexible membrane of the apparatus seals the top of the reservoir. The flexible membrane is to expand and contract over the reservoir in accordance with the volume of the fluid currently stored within the reservoir. A sensing mechanism of the apparatus is to directly or indirectly sense the volume of the fluid currently stored within the reservoir.

15 Claims, 10 Drawing Sheets

INTERMEDIATE FLUID SUPPLY APPARATUS HAVING FLEXIBLE MEMBRANE

BACKGROUND

Fluid-ejection devices include inkjet-printing devices that are commonly employed to form images on media like paper using ink. In many types of fluid-ejection devices, a number of fluid-ejection nozzles of a fluid-ejection mechanism eject fluid onto a current swath of media incident to the mechanism, with the mechanism remaining stationary or while the mechanism moves across the current swath. The media is then typically moved so that the fluid-ejection mechanism is incident to the next swath of media, and the fluid-ejection nozzles of the mechanism eject fluid on this new swath. This process is repeated until the entirety of the media has had fluid ejected thereon as desired.

DETAILED DESCRIPTION

Statement of Problem

Figure 1:
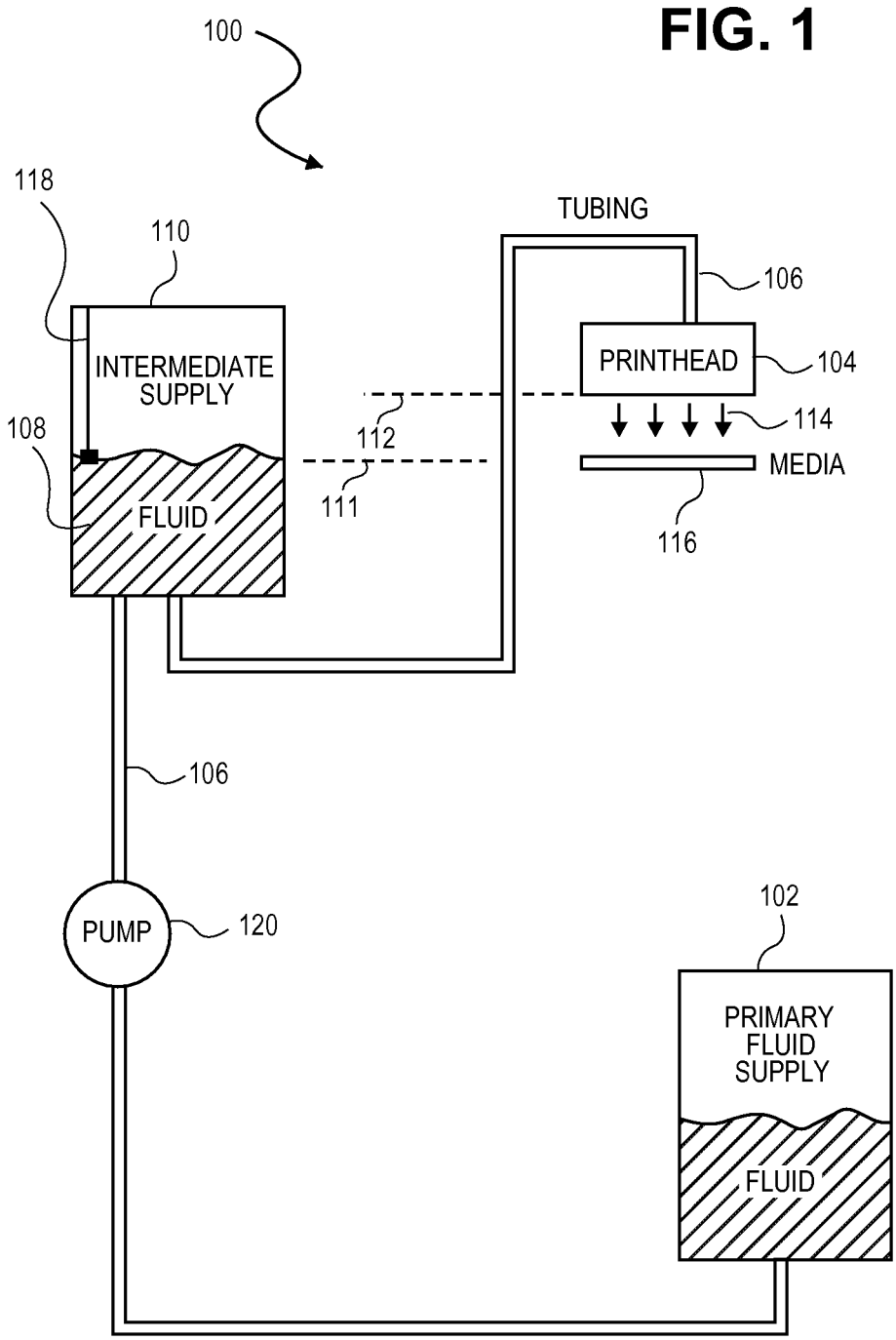
FIG. 1 is a diagram of a fluid-ejection device having an intermediate fluid supply in relation to which problems that have been overcome by the inventors are described, according to an embodiment of the present disclosure.

FIG. 1 shows a fluid-ejection device 100, according to an embodiment of the present disclosure. The problems that the inventors have overcome are described in relation to the fluid-ejection device 100, which represents an early attempt by the inventors to include an intermediate fluid supply 110 as well as a primary fluid supply 102 within a fluid-ejection device, which is advantageous for reasons described below. The fluid-ejection device 100 may be an inkjet-printing device, such as an inkjet printer, for instance. The fluid-ejection device 100 includes the primary fluid supply 102 and a fluid-ejection printhead 104, as well as the intermediate fluid supply 110 fluidically interconnected to the primary fluid supply 102 via tubing 106. The fluid-ejection printhead 104 ejects fluid 108 supplied to the intermediate fluid supply 110 from the primary fluid supply 102 via a pump 120 onto media 216, such as paper, as indicated by the arrows 114.

The intermediate fluid supply 110 is intermediate in the sense that it is located between the fluid-ejection printhead 104 and the primary fluid supply 102. The intermediate fluid supply 110 can store a volume of fluid that is less than the volume of fluid stored by the primary fluid supply 102, although this is not readily depicted in FIG. 1. In this sense, the primary fluid supply 102 is primary, because it stores more fluid than the intermediate fluid supply 110 does.

The purpose of having both the intermediate fluid supply 110 as well as the primary fluid supply 102 is to permit the fluid-ejection device 100 to be able to continuously eject fluid onto media, such as paper, for relatively long lengths of time, such as hours if not days, without stopping. While small-scale fluid-ejection devices, such as consumer- and office-grade inkjet-printing devices, are not expected to continuously eject fluid for such long lengths of time without stopping, industrial-grade inkjet-printing devices, and other types of fluid-ejection devices, are. In this respect, the intermediate fluid supply 110 directly supplies the fluid-ejection printhead 104 with fluid to eject, and the primary fluid supply 102 periodically replenishes the intermediate fluid supply 110 with fluid.

For the fluid-ejection device 100 to operate properly, the level of the fluid 108 within the intermediate fluid supply 110, as indicated by the dotted line 111, has to be below the bottom surface of the fluid-ejection printhead 104, as indicated by the dotted line 112. The bottom surface of the fluid-ejection printhead 104 can correspond to the location of the printhead die containing fluid-ejection nozzles through which fluid is actually ejected from the printhead 104, for example. The reason the level of the fluid 108 has to be below the bottom surface of the fluid-ejection printhead 104 is to ensure that there is adequate negative pressure within the printhead 104. If there is inadequate negative pressure within the fluid-ejection printhead 104, then fluid may drool from the fluid-ejection nozzles at the bottom of the printhead 104, causing degraded quality of fluid ejection.

However, positioning the fluid supply 102 in relation to the fluid-ejection printhead 104 to maintain the desired spatial relationship between the dotted lines 111 and 112 can be problematic. First, such optimal positioning means that that a relatively large length of the tubing 106 is required, which is disadvantageous because then adequate provisions have to be made to route the tubing 106 within the fluid-ejection device 100. Second, optimal positioning of the fluid supply 102 in relation to the fluid-ejection printhead 104 restricts the locations within the fluid-ejection device 100 in which the fluid supply 102 can be located. Such locational restriction of the fluid supply 102 can be an impediment to minimizing the size of the fluid-ejection device 100, and can also be an impediment to locating the fluid supply 102 in a location in which it is easily serviced by the users of the device 100.

Furthermore, the tubing 106 particularly from the intermediate fluid supply 110 to the fluid-ejection printhead 104 has to have a relatively large diameter. The fluid-ejection nozzles of the fluid-ejection printhead 104 act as small pumps, drawing fluid from the intermediate fluid supply 110 as the fluid is ejected through the nozzles. However, the pumping force capable of being exerted by the fluid-ejection nozzles is relatively small. Therefore, the diameter of the tubing 106 from the intermediate fluid supply 110 to the fluid-ejection printhead 104 has to be relatively large, so that the fluid-ejection nozzles are indeed capable of pumping fluid from the intermediate fluid supply 110. If the tubing 106 has too small a diameter between the intermediate fluid supply 110 and the fluid-ejection printhead 104, then the pumping force required to move fluid from the intermediate fluid supply 110 to the printhead 104 will be greater than the pumping force that the fluid-ejection nozzles of the printhead 104 can exert.

However, having relatively large-diameter tubing 106 between the intermediate fluid-supply 110 and the fluid-ejection printhead 104 is disadvantageous as well. Large-diameter tubing 106 is more difficult to position and route within the fluid-ejection device 100, for instance. In addition, large-diameter tubing 106, when filled with fluid, is relatively heavy, which can make it more difficult to move the fluid-ejection printhead 104 back and forth over the media 106 while that the printhead 104 is ejecting fluid onto the media 106. Undesirable waves of pressure can also be introduced due to such relatively large amounts of fluid being moved back and forth during corresponding movement of the fluid-ejection printhead 104 while the printhead 104 is ejecting fluid.

In this respect, it is noted that the pump 120 in the fluid-ejection device 100 of FIG. 1 serves just to pump fluid from the primary fluid supply 102 to the intermediate fluid supply 110, and not from the intermediate fluid supply 110 to the fluid-ejection printhead 104. When the level of fluid 108 within the intermediate fluid supply 110 drops to more than a predetermined amount below the level indicated by the dotted line 111, a buoyancy-type fluid level detector 118 sends a signal to the pump 120 to pump more fluid from the primary fluid supply 102 to the intermediate fluid supply 110. When the fluid within the intermediate fluid supply 110 again reaches the level denoted by the dotted line 111, the fluid level detector 118 sends a signal to the pump 120 to stop pumping fluid from the primary fluid supply 102 to the intermediate fluid supply 110.

Figure 2:
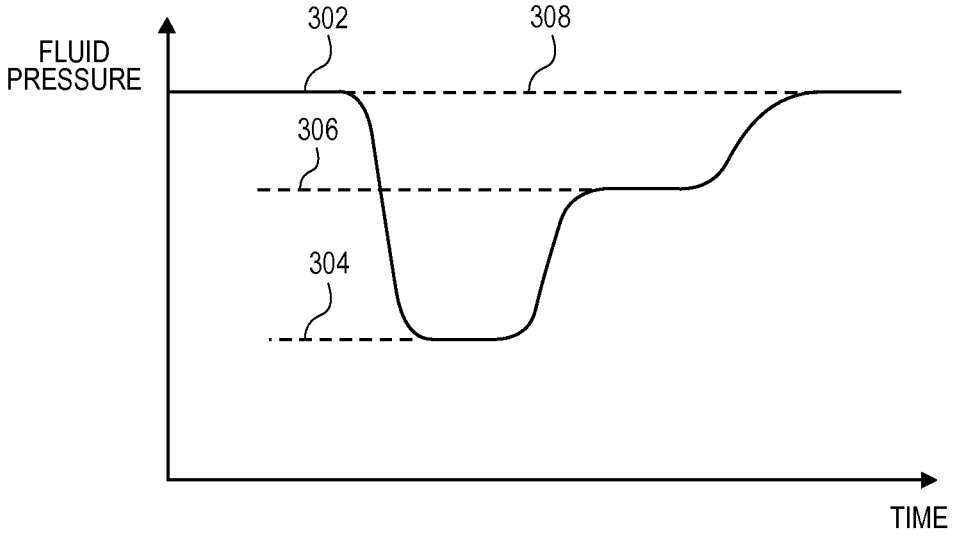
FIG. 2 is a diagram of a plot of fluid pressure as a function of time in relation to the fluid-ejection device of FIG. 1, according to an embodiment of the present disclosure.

FIG. 2 shows a plot of fluid pressure at the interface between the tubing 106 and the fluid-ejection printhead 104 of FIG. 1 as a function time, during fluid ejection by the printhead 204, according to an embodiment of the present disclosure. As the fluid-ejection printhead 104 ejects fluid from the intermediately fluid supply 110, the fluid pressure drops from an original level 308 to precipitously near, if not below, a given threshold level 304, as indicated by the line 302. Thereafter, once the fluid starts flowing from the intermediate fluid supply 110 to the fluid-ejection printhead 110 as a result of the pumping action exerted by the fluid-ejection nozzles of the printhead 104, the fluid pressure increases to and stabilizes at another level 306. Once the fluid-ejection printhead 110 stops ejecting fluid, the fluid pressure rises to the original level 308.

However, when the fluid pressure reaches the threshold level 304, the fluid-ejection printhead 104 can be starved of fluid to eject from the fluid-ejection nozzles of the printhead die of the printhead 104. As such, the fluid-ejection printhead 104 may begin to suction air through the fluid-ejection nozzles. The suctioned air forms air bubbles within the fluid-ejection printhead 104, and may later be ejected from the printhead 104 in lieu of fluid, degrading fluid-ejection quality of the fluid-ejection device 100 of FIG. 1. This is another disadvantage of the fluid-ejection device 100.

Overview of Solution

Figure 3:
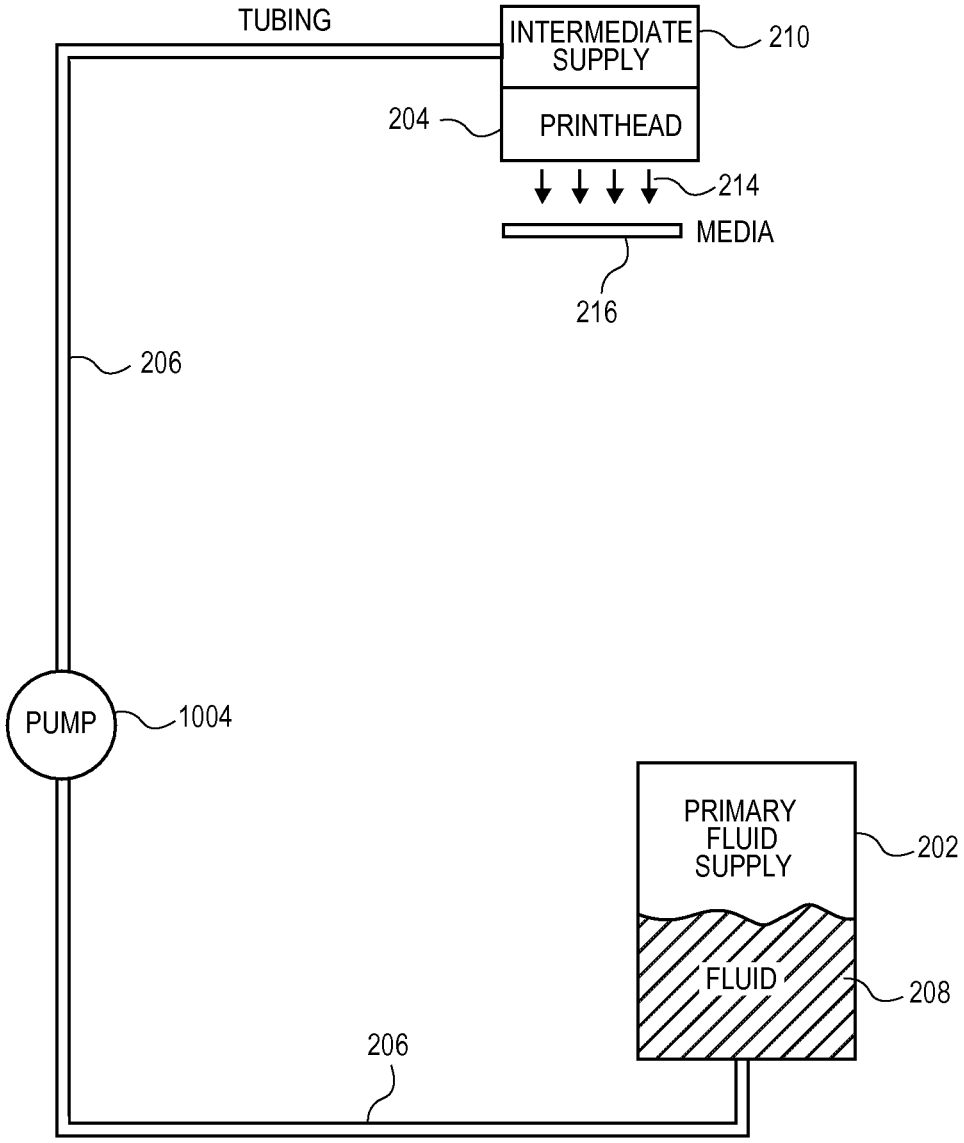
FIG. 3 is a diagram of a fluid-ejection device having an intermediate fluid supply that overcomes the problems associated with the fluid-ejection device of FIG. 1, according to an embodiment of the present disclosure.

FIG. 3 shows a fluid-ejection device 200, according to an embodiment of the present disclosure. The fluid-ejection device 200 of FIG. 3 is the solution developed by the inventors that overcome the problems of having both an intermediate fluid supply and a primary fluid supply, as described in the preceding section of the detailed description. The fluid-ejection device 200 may be an inkjet-printing device, such as an inkjet printer, for instance. In one embodiment, the fluid-ejection device 200 may be a commercial-grade inkjet-printing device, which is capable of continuously ejecting fluid onto media, such as paper, for long lengths of time, such as hours if not days, without stopping. As such, the fluid-ejection device 200 includes a primary fluid supply 202 and an intermediate fluid supply 210 fluidically interconnected to the primary fluid supply 202 by tubing 206, as well as a fluid-ejection printhead 204. The fluid-ejection printhead 204 ejects fluid 208 supplied by the primary fluid supply 202 through the intermediate fluid supply 210 onto media 216, such as paper, as indicated by the arrows 214.

The intermediate fluid supply 210 may also be referred to as an intermediate fluid supply apparatus. The intermediate fluid supply 210 is intermediate in the sense that it is located between the fluid-ejection printhead 204 and the primary fluid supply 202. The intermediate fluid supply 210 can store a volume of fluid than is less in than the volume of fluid 208 stored by the primary fluid supply 202. In this sense, the primary fluid supply 202 is primary, because it stores more fluid than the intermediate fluid supply 210 does.

The intermediate fluid supply 210 can be located above the fluid-ejection printhead 204, because the intermediate fluid supply 210 maintains the negative pressure within the printhead 204. The intermediate fluid supply 210 can maintain the negative pressure within the fluid-ejection printhead 204 even when located above the printhead 204, because there is no relatively long and relatively large-diameter tubing interconnecting the intermediate fluid supply 210 with the printhead 204. It is noted that this is in contradistinction to the fluid-ejection device 100 of FIG. 1 that has been described above.

The tubing 206 that is present in FIG. 3 can also be relatively short in length as compared to the tubing 106 of FIG. 1, due to the greater freedom in positioning the primary fluid supply 202 within the fluid-ejection device 100. Furthermore, because the intermediate fluid supply 202 is located very close, if not immediately adjacent, to the fluid-ejection printhead 104, the fluid-ejection nozzles of the printhead 104 do not act as small pumps as they do in the fluid-ejection device 100 of FIG. 1. Therefore, the tubing 206 that is present in FIG. 3 can have a relatively small diameter as compared to the tubing 106 of FIG. 1.

Figure 4:
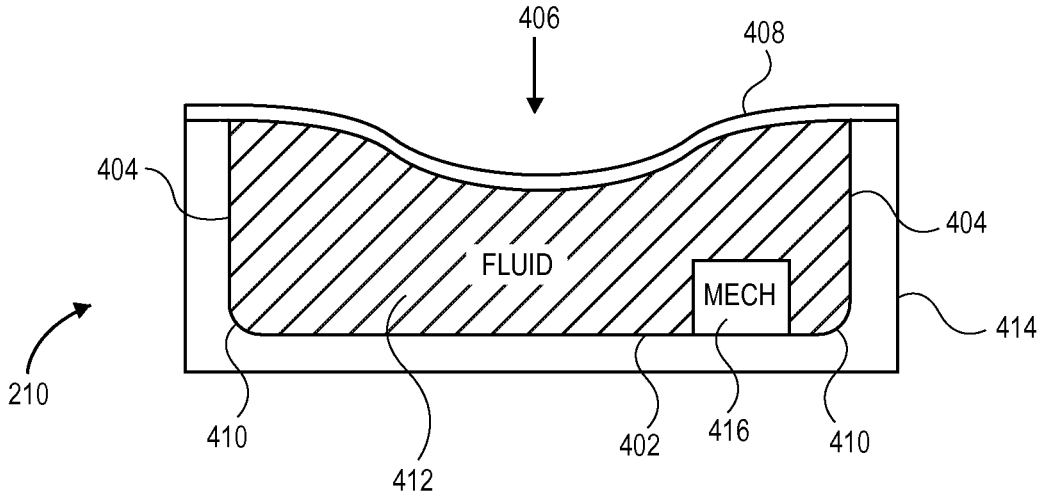
FIG. 4 is a diagram of the intermediate fluid supply of the fluid-ejection device of FIG. 3 in detail, according to an embodiment of the present disclosure.

FIG. 4 shows the intermediate fluid supply 210 devised by the inventors in more detail, according to a general embodiment of the present disclosure. It is noted that FIG. 4 does not show how the intermediate fluid supply 210 is fluidically connected to the primary fluid supply 202 and the fluid-ejection printhead 204 of FIG. 3, for illustrative clarity and convenience. The intermediate fluid supply 210 includes a reservoir 414 that has a rigid bottom surface 402 and rigid side surfaces 404, but that is otherwise open at a top 406 of the reservoir 414. The reservoir 414 stores fluid 412 that is supplied from the primary fluid supply 202 of FIG. 3.

The intermediate fluid supply 210 further includes a flexible membrane 408 sealing the top 406 of the reservoir 414. The flexible membrane 408 is sufficiently flexible to expand and contract over the reservoir 414 in accordance with the volume of the fluid 412 currently stored within the reservoir 414. More specifically, the flexible membrane 408 contracts towards and into the reservoir 414 as the volume of the fluid 412 stored within the reservoir 414 decreases due to ejection of the fluid by the fluid-ejection printhead 204 of FIG. 3. By comparison, the flexible membrane 408 expands away from and out of the reservoir 414 as the volume of the fluid 412 stored within the reservoir 414 increases due to the fluid 208 being pumped from the primary fluid supply 202 of FIG. 3 into the reservoir 414.

The contraction of the flexible membrane 408 minimizes changes in pressure within the intermediate fluid supply 210 as the fluid 412 is ejected by the fluid-ejection printhead 204 of FIG. 3. Such minimization in the pressure change within the intermediate fluid supply 210 helps prevent fluid starvation as has been described in relation to FIG. 2. The expansion of the flexible membrane 408 also minimizes changes within the intermediate fluid supply 210, as the fluid 208 is pumped from the primary fluid supply 202 of FIG. 3 to the intermediate fluid supply 210.

The intermediate fluid supply 210 also includes a sensing mechanism 416 that is rudimentarily depicted and located within FIG. 4. The sensing mechanism 416 senses, directly or indirectly, the volume of the fluid 412 currently stored within the reservoir 414. For example, the sensing mechanism 416 may be a fluid volume sensor that directly senses, detects, or measures the volume of the fluid 412 currently stored within the reservoir 414. As another example, the sensing mechanism 416 may be a pressure sensor that indirectly senses the volume of the fluid 412 currently stored within the reservoir 414 by directly sensing, detecting, or measuring the pressure inside the reservoir 414.

The sensing mechanism 416 is employed to determine when the level of the fluid 412 within the reservoir 414 of the intermediate fluid supply 210 has dropped sufficiently to warrant replenishment from the fluid 208 of the primary fluid supply 202 via the pump 1004 of FIG. 3. As such, the sensing mechanism 416 also helps prevent fluid starvation as has been described in relation to FIG. 2, by ensuring that an adequate amount of the fluid 412 is present within the reservoir 414 at least substantially at all times. Thus, the inclusion of the flexible membrane 408 and the sensing mechanism 416 within the intermediate fluid supply 210 of FIG. 4 overcomes the problems associated with the intermediate fluid supply 210 of FIG. 3 that have been discussed above.

It is further noted that the interior of the reservoir 414 desirably includes rounded corners 410 where the side surfaces 404 meet the bottom surface 402 of the reservoir 414. The corners 410 are desirably rounded, as opposed to being sharp, angled corners, to at least substantially inhibit gaseous bubbles, such as air bubbles, from becoming indefinitely lodged at the corners 410. That is, insofar as such air bubbles may form or be introduced into the fluid 412 stored within the reservoir, the rounded corners 410 help ensure that the air bubbles float to the top 406 of the reservoir 414, and do not become lodged at the bottom of the reservoir 414 at the corners 410.

Figure 5:
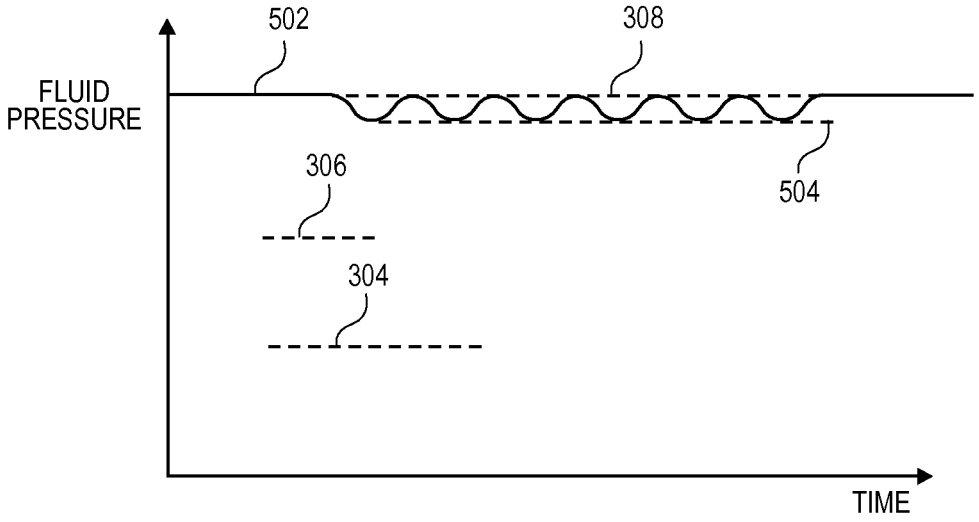
FIG. 5 is a diagram of a plot of fluid pressure as a function of time in relation to the fluid-ejection device of FIG. 3, according to an embodiment of the present disclosure.

FIG. 5 shows a plot of fluid pressure at the interface between the intermediate fluid supply 210 and the fluid-ejection printhead 204 of FIG. 3 as a function of time, during fluid ejection by the printhead 204, according to an embodiment of the present disclosure. As the fluid-ejection printhead 204 ejects fluid from the intermediate fluid supply 210, the fluid pressure begins to decrease from the original level 308 to the threshold level 504. It is noted that the rate of decrease (i.e., the maximum downward slope of the line 502) in FIG. 5 is less than the rate of decrease (i.e., the maximum downward slope of the line 302) in FIG. 3 due to the inclusion of the flexible membrane 408.

The sensing mechanism 416 detects when the fluid pressure has dropped to the threshold level 504. The threshold level 504 is greater than the threshold level 304 of FIG. 2 at which fluid starvation occurs, as well as greater than the level 306 of FIG. 2. The threshold level 504 is greater than the threshold level 304 of FIG. 2 at least in part because the distance through which fluid is drawn from the intermediate fluid supply 210 to the fluid-ejection printhead 204 is decreased in FIG. 3 as compared to the distance through which fluid is drawn from the intermediate fluid supply 110 to the printhead 104 in FIG. 1.

Thus, at the threshold level 504, the pump 1004 begins to pump the fluid 208 from the primary fluid supply 202 to replenish the intermediate fluid supply 210 of FIG. 3. When the sensing mechanism 416 detects that the fluid pressure has risen back to a threshold level, such as near or at the original level 308, the pump 1004 stops resupplying the fluid 208 from the primary fluid supply 202 to the intermediate fluid supply 210. This cycle of the fluid pressure dropping and then rising is repeated until the fluid-ejection printhead 204 has finished ejecting fluid.

Therefore, the flexible membrane 408 and the sensing mechanism 416 together ensure that the fluid pressure desirably does not drop to the threshold level 304 at which fluid starvation occurs within the fluid-ejection printhead 204 of FIG. 3. The flexible membrane 408 dampens or minimizes changes in the fluid pressure, which results in the rate at which the fluid pressure decreases to be less than in the plot of FIG. 2. This provides sufficient time for the sensing mechanism 416 to detect that the fluid pressure has dropped to the threshold level 504 and for the pump 1004 to begin pumping the fluid 208 from the primary fluid supply 202 of FIG. 3 to replenish the intermediate fluid supply 210 of FIG. 4, before the fluid pressure has dropped to the threshold level 304 at which fluid starvation occurs.

In the following section of the detailed description, a more detailed embodiment of the intermediate fluid supply 210 of FIG. 4 is presented, including a more detailed embodiment of the fluid-ejection device 200 of FIG. 3 that can include the intermediate fluid supply 210 of FIG. 4. This more detailed embodiment presents further enabling details, as well as features of the intermediate fluid supply 210 that are not shown in FIG. 4. Finally, the detailed description concludes with description of a method of exemplary operation of such a fluid-ejection device 200 that includes such an intermediate fluid supply 210.

Specific Embodiment of Intermediate Fluid Supply

Figure 6:
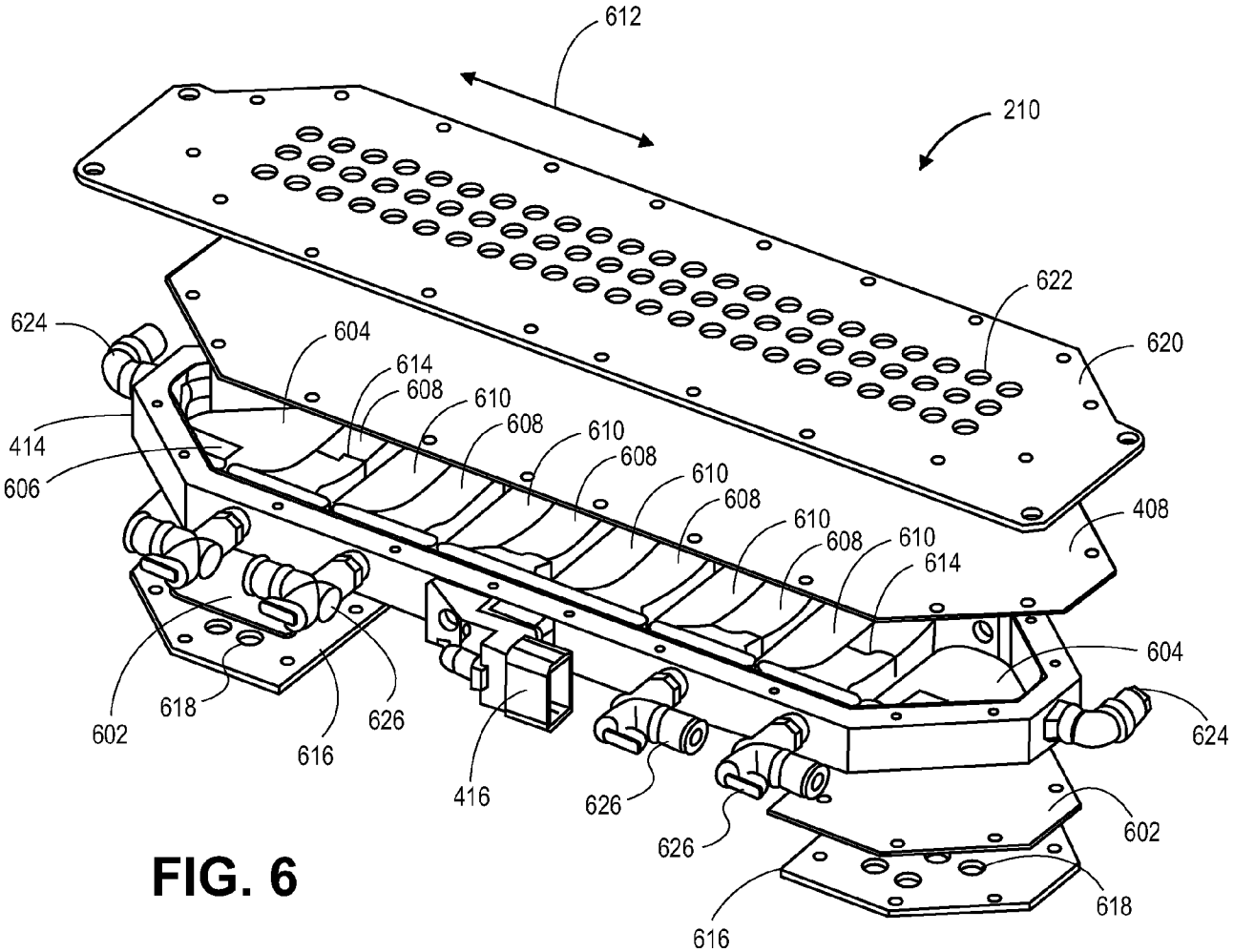
FIG. 6 is a diagram of an exploded perspective view of the intermediate fluid supply of FIG. 4 in more detail, according to an embodiment of the present disclosure.
Figure 7:
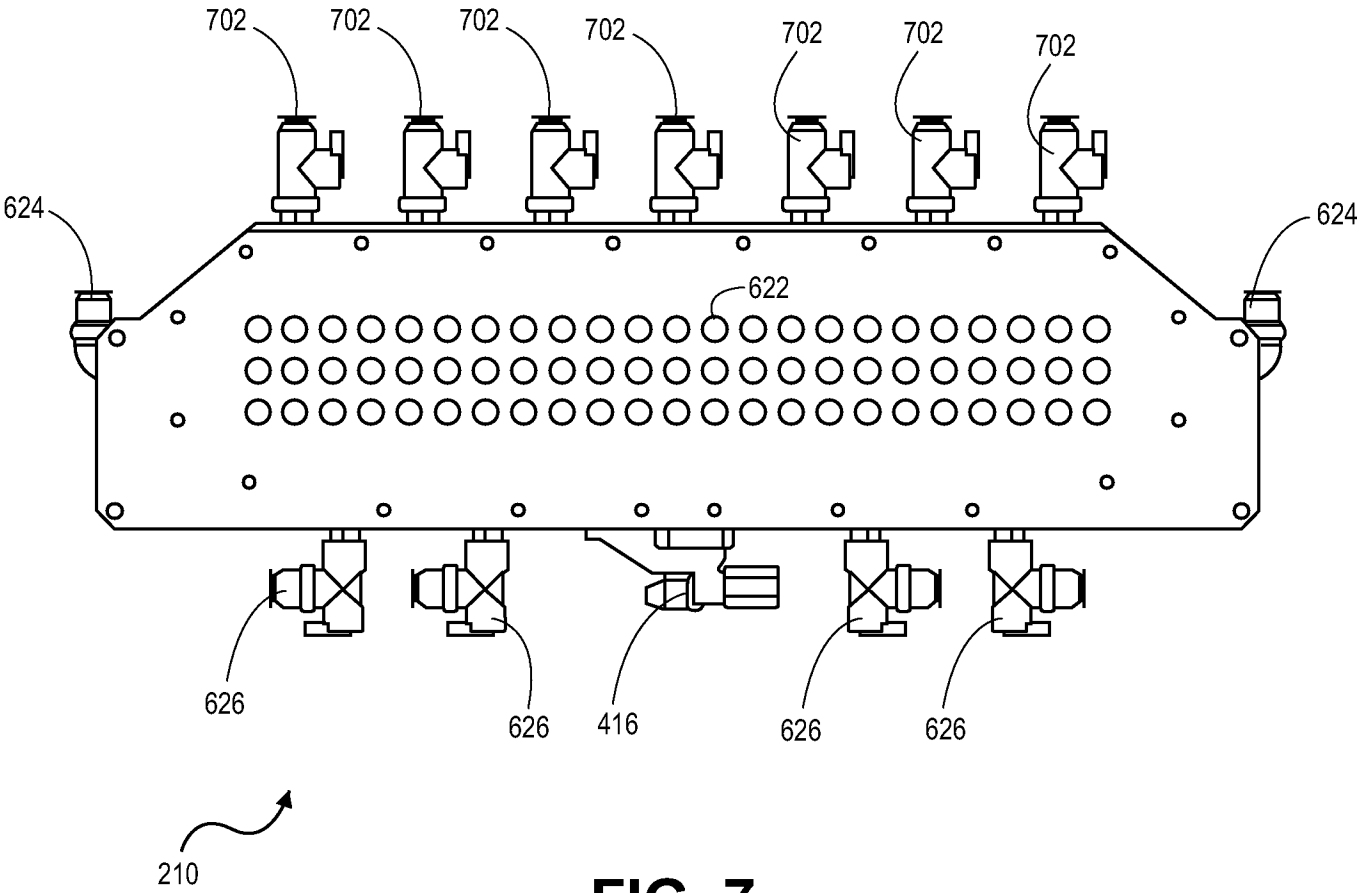
FIG. 7 is a diagram of a top view of the intermediate fluid supply of FIG. 6, according to an embodiment of the present disclosure.

FIGS. 6 and 7 show an exploded perspective view and a top view, respectively, of the intermediate fluid supply 210, according to a more specific embodiment of the present disclosure. As in FIG. 3, the intermediate fluid supply 210 of FIGS. 6 and 7 includes the reservoir 414, the flexible membrane 408, and the sensing mechanism 416. The reservoir 414 further includes a pair of side cavities 604 located on the bottom of the reservoir 414 at short sides of the reservoir 414 in relation to an axis of movement 612 of the intermediate fluid supply 210. The bottom of the reservoir 414 has a pair of openings 606 corresponding to the cavities 606.

In one embodiment, the intermediate fluid supply 210 may move back and forth as indicated by the axis 612, in accordance with corresponding movement of the fluid-ejection printhead 204. As such, fluid can be ejected as desired from the printhead 204 as the printhead 204 and the intermediate fluid supply 210 move over a current swath of media currently incident to the printhead 204. In this embodiment, once the current swath has had fluid ejected thereon, the media is moved perpendicular to the axis 612 so that the next swath is incident to the printhead 204 for fluid to be ejected as desired onto this swath as the printhead 204 and the intermediate fluid supply 210 move over the swath. This process is repeated until all the swaths of media have had fluid ejected thereon as desired.

The intermediate fluid supply 210 includes a pair of secondary flexible membranes 602 sealing the openings 606 that lead to the side cavities 604. The secondary flexible membranes 602, like the (primary) flexible membrane 408, expand and contract under the reservoir in accordance with changing volumes of the fluid currently located within the cavities 604. In particular, the secondary flexible membranes 602 expand and contract resulting from changing volumes of the fluid currently located within the cavities 604 due to movement of the intermediate fluid supply apparatus 210 along the axis of movement 612, as is described in more detail later in the detailed description.

The intermediate fluid supply 210 further includes a number of partitions 608 located within the reservoir 414. The left-most and the right-most partitions 608 define the side cavities 604. All of the partitions 608 together define a number of fluid channels 610 that are perpendicular to the long sides of the intermediate fluid supply 210 in relation to the axis of movement 612. Thus, the fluid channels 610 run perpendicular to the axis of movement 612. Each fluid channel 610 includes a corresponding fluid passageway therethrough, such as the fluid passageways 614 specifically called out in FIG. 6. These fluid passageways fluidically couple the fluid channels 610 with one another, and to the side cavities 604. The purpose of the partitions 608 is to decrease the speed at which fluid moves, or "sloshes," between from one of the side cavities 604 to the other of the side cavities 604 during movement of the intermediate fluid supply 210 along the axis of movement 612.

The intermediate fluid supply 210 includes a pair of rigid bottoms 616 that are attached to the bottom of the reservoir 414 over the secondary flexible membranes 602. The rigid bottoms 616 protect the secondary flexible membranes 602 from accidental puncture. The rigid bottoms 616 include a number of holes 618 to expose the bottoms of the secondary flexible membranes 602 to ambient pressure, however. Likewise, the intermediate fluid supply 210 includes a rigid top 620 attached to the top of the reservoir 414 over the (primary) flexible membrane 408 to protect the flexible membrane 408. The rigid top 620 also has a number of holes 622 to expose the top of the flexible membrane 408 to ambient pressure.

The intermediate fluid supply 210 includes a number of fluid inlets 626, a number of fluid outlets 624, and a number of fluid ports 702. The fluid inlets 626 fluidically couple the primary fluid supply 202 of FIG. 3 to the reservoir 414 along a first long side of the reservoir 414, to supply fluid from the primary fluid supply 202 to the reservoir 414. The fluid outlets 624 are fluidically coupled to the reservoir 414 along the short sides of the reservoir 414, to drain fluid from the reservoir 414, and to further drain any air bubbles within the fluid contained within the reservoir 414. The fluid ports 702 of FIG. 7 fluidically couple the fluid-ejection printhead 204 of FIG. 3 to the reservoir 414 along a second long side (opposite the first long side) of the reservoir 414, to supply fluid from the reservoir 414 to the printheads 204.

Figure 8A:
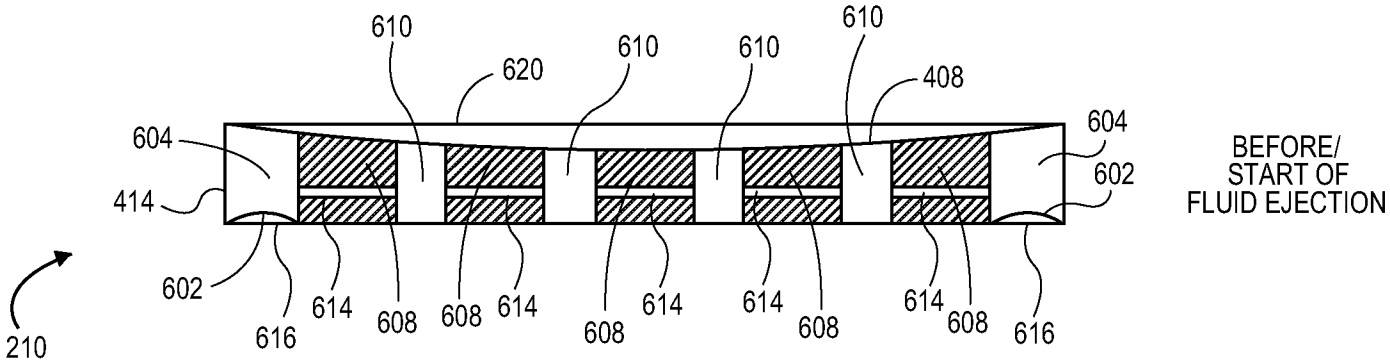
FIGS. 8A and 8B are diagrams of cross-sectional views of the intermediate fluid supply of FIG. 6 before or at the beginning of fluid ejection and after or during fluid ejection, respectively, according to an embodiment of the disclosure.
Figure 8B:
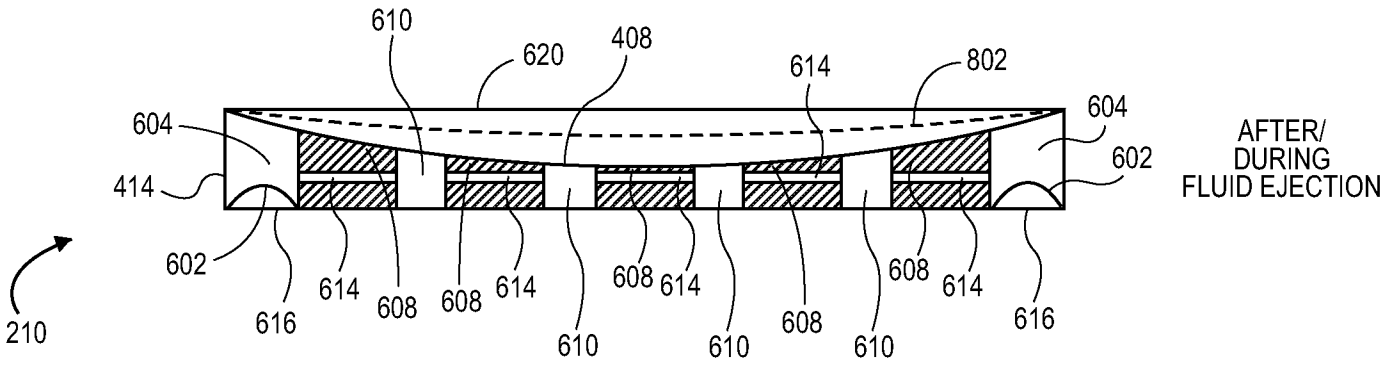

FIGS. 8A and 8B show cross-sectional views of the intermediate fluid supply 210 before or at the start of fluid ejection, and after or during fluid ejection, respectively, according to an embodiment of the present disclosure. In both FIGS. 8A and 8B, the (primary) flexible membrane 408 with its corresponding rigid top 620, and the secondary flexible membranes 602 with their corresponding rigid bottoms 616, are depicted. The reservoir 414, the side cavities 604 and the fluid channels 610 are also depicted, as are the partitions 608 with their fluid passageways 614 running through the partitions 608.

Before or at the start of fluid ejection by the fluid-ejection printhead 204 of FIG. 3, the flexible membrane 408 and the secondary flexible membranes 602 are in the positions shown in FIG. 8A. After or during fluid ejection by the fluid-ejection printhead 204, the flexible membrane 408 and the secondary flexible membranes 602 recede into the reservoir 414, as shown in FIG. 8B, to minimize the pressure change within the intermediate fluid supply 210 resulting from the ejection of the fluid from the intermediate fluid supply 210. For example, the dotted line 802 in FIG. 8B depicts the original position of the flexible membrane 408 of FIG. 8A to present a visual comparison of the position of the membrane 408 in FIG. 8B in relation to the position of the membrane 408 in FIG. 8A.

Figure 9A:
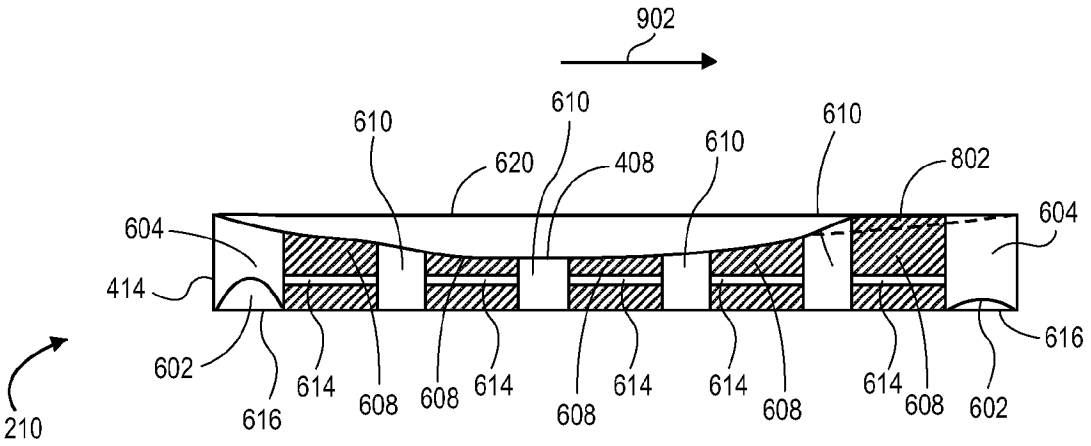
FIGS. 9A and 9B are diagrams of cross-sectional views of the intermediate fluid supply of FIG. 6 while moving to the right and to the left, respectively, according to an embodiment of the present disclosure.
Figure 9B:
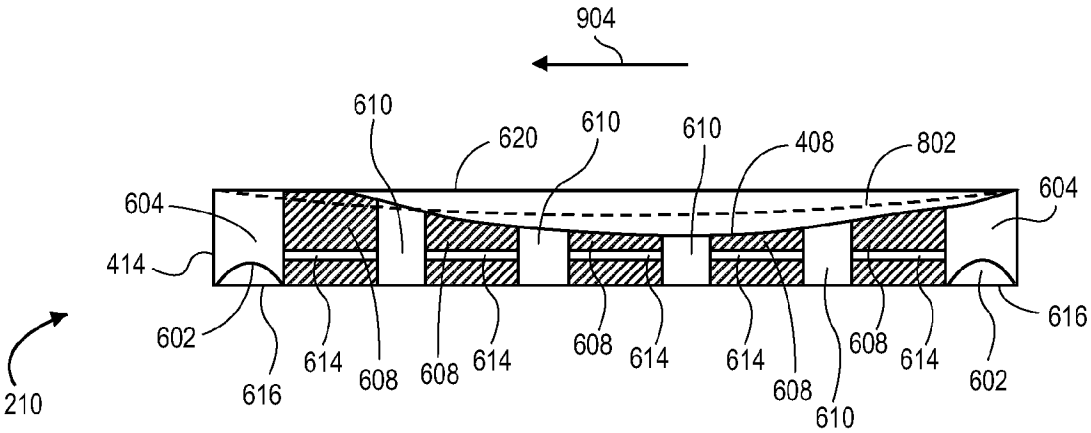

FIGS. 8A and 8B presume that the intermediate fluid supply 210 remains stationary while fluid ejection from the fluid-ejection printhead 204 occurs. In actuality, however, the intermediate fluid supply 210 is to move along the axis of movement 612 of FIG. 6 during fluid ejection by the fluid-ejection printhead 204. FIGS. 9A and 9B thus show cross-sectional views of the intermediate fluid supply 210 during fluid ejection while the intermediate fluid supply 210 moves to the right and to the left, respectively, according to an embodiment of the present disclosure.

In both FIGS. 9A and 9B, the (primary) flexible membrane 408 with its corresponding rigid top 620, and the secondary flexible membranes 602 with their corresponding rigid bottoms 616, are depicted. The reservoir 414 of the intermediate fluid supply 210 is also depicted. The side cavities 604 and the fluid channels 610 are depicted, as are the partitions 608 with their fluid passageways 614 running through the partitions 608. The dotted line 802 in FIGS. 9A and 9B indicates the original position of the flexible membrane 408 in FIG. 8A.

In FIG. 9A, the intermediate fluid supply 210 is moving from left to right, as denoted by the arrow 902. As such, the fluid within the reservoir 414 correspondingly moves towards the right of the intermediate flight supply 210, such that there is more fluid within the right cavity 604 than in the left cavity 604, and such that there is more fluid within the fluid channels 610 towards the right than within the fluid channels 610 towards the left. Therefore, the flexible membrane 408 contractively deforms inwards towards the left of the intermediate fluid supply 210 and expansively deforms outwards towards the right of the intermediate fluid supply 210. Likewise, the left flexible membrane 602 contractively deforms inwards, whereas the right flexible membrane 602 expansively deforms outwards.

By comparison, in FIG. 9B, the intermediate fluid supply 210 is moving from right to left, as denoted by the arrow 904. As such, the fluid within the reservoir 414 correspondingly moves towards the left of the intermediate fluid supply 210, such that there is more fluid within the left cavity 604 than in the right cavity 604, and such that there is more fluid within the fluid channels 610 towards the left than within the fluid channels 610 towards the right. Therefore, the flexible membrane 408 contractively deforms inwards towards the right of the intermediate fluid supply 210 and expansively deforms outwards towards the left of the intermediate fluid supply 210. Likewise, the right flexible membrane 602 contractively deforms inwards, whereas the left flexible membrane 602 expansively deforms outwards.

Representative Fluid-Ejection Device and Concluding Method

Figure 10:
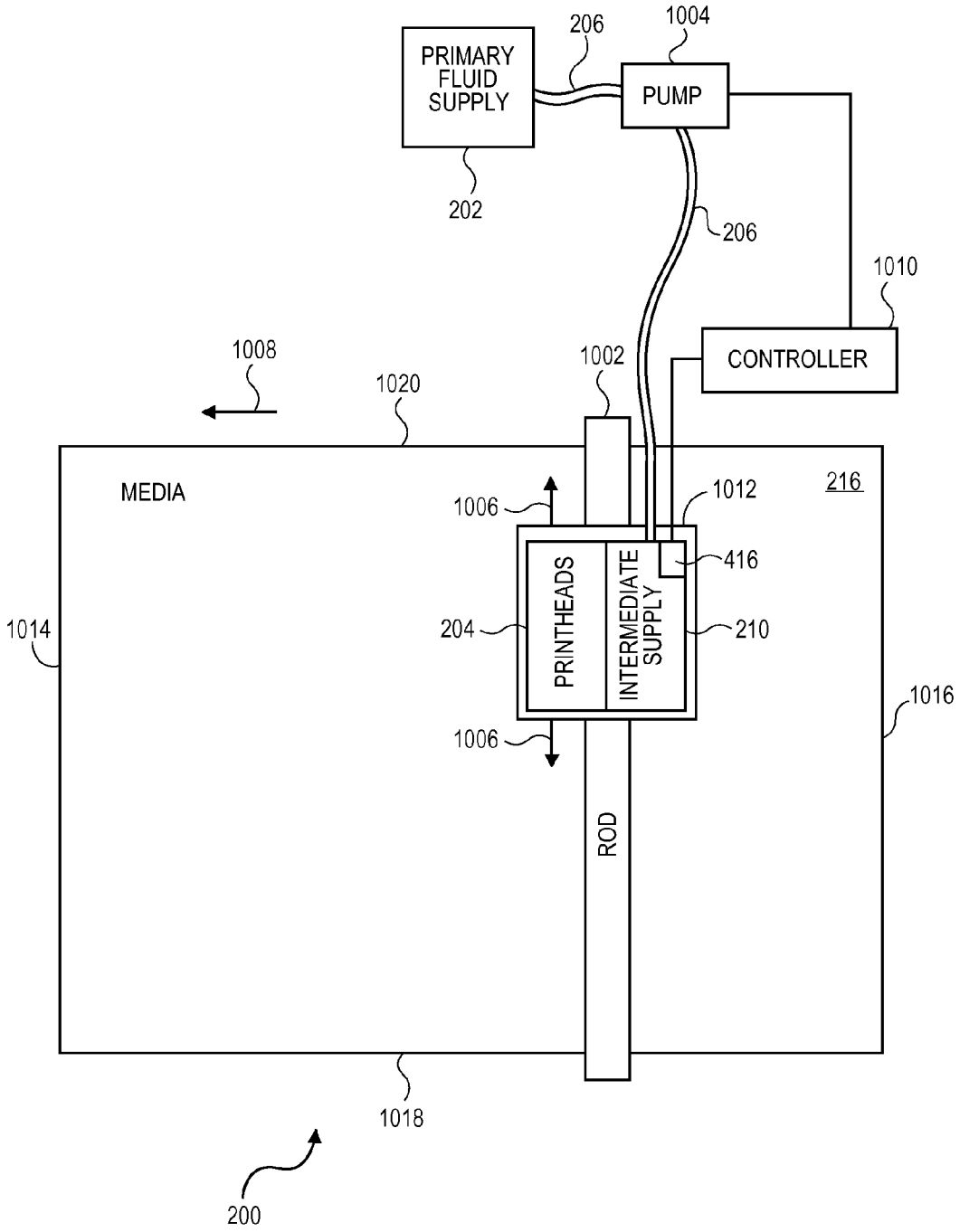
FIG. 10 is a diagram of a fluid-ejection device that is consistent with but more detailed than the fluid-ejection device of FIG. 3, according to an embodiment of the present disclosure.

FIG. 10 shows the fluid-ejection device 200 of FIG. 3 in detail, according to an embodiment of the present disclosure.

The fluid-ejection device 200 may be an inkjet-printing device, which is a device, such as a printer, that ejects ink onto media, such as paper, to form images, which can include text, on the media. The fluid-ejection device 200 is more generally a fluid-ejection precision-dispensing device that precisely dispenses fluid, such as ink. The fluid-ejection device 200 may eject pigment-based ink, dye-based ink, another type of ink, or another type of fluid. Embodiments of the present disclosure can thus pertain to any type of fluid-ejection precision-dispensing device that dispenses a substantially liquid fluid.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. As such, a fluid-ejection precision-dispensing device is in comparison to a continuous precision-dispensing device, in which a substantially liquid fluid is continuously dispensed therefrom. An example of a continuous precision-dispensing device is a continuous inkjet-printing device.

The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids include drugs, cellular products, organisms, fuel, and so on, which are not substantially or primarily composed of gases such as air and other types of gases, as can be appreciated by those of ordinary skill within the art.

The fluid-ejection device 200 includes the primary fluid supply 202, one or more fluid-ejection printheads 204, the intermediate fluid supply 210, a movable carriage 1012 movably disposed on a rod 1002, the pump 1004, and a controller 1010. The primary fluid supply 202 stores fluid, as has been described. The fluid-ejection printheads 204 eject the fluid, as supplied by the intermediate fluid supply 210 from the primary fluid supply 202, in a desired manner. The intermediate fluid supply 210 and the fluid-ejection printheads 204 are disposed on the movable carriage 1012. Tubing 206 fluidically interconnects the intermediate fluid supply 210 to the primary fluid supply 202 via the pump 1004. The controller 1010 is electrically communicatively connected to the fluid-ejection printheads 204, the intermediate fluid supply 210, and the pump 1004. The intermediate fluid supply 210 can be located above the fluid-ejection printheads 204 along a z-axis perpendicular to the plane of FIG. 10, which is not specifically depicted in FIG. 10.

In operation, the media 216, such as sheet of paper, is longitudinally moved on a swath-by-swath basis from a leading edge 1014 of the media 216 to a lagging edge 1016 of the media 216 under the carriage 1012, as indicated by the arrow 1008. The arrow 1008 denotes a longitudinal axis of the media 216, which is typically parallel to the long sides (i.e., the edges 1018 and 1020) of the media 216. A swath is defined as the maximum portion of the media 216, from the leading edge 1014 to the lagging edge 1016, on which the fluid-ejection printheads 204 can eject fluid. There are a number of consecutive such swaths between the edges 1014 and 1016. Each swath latitudinally extends between the edges 1018 and 1020. The latitudinal axis of the media 216 is perpendicular to the longitudinal axis of the media 216, and is typically parallel to the short sides (i.e., the edges 1014 and 1016) of the media 216.

The fluid-ejection printheads 204 eject fluid from the intermediate fluid supply 210 onto a current swath of the media 216 incident to (i.e., under) the printheads 204, as the carriage 1012 on which the printheads 204 and the intermediate fluid supply 210 are disposed move back and forth, as indicated by the arrows 1006. The fluid-ejection printheads 204 eject fluid in a desired manner onto the current swath of the media 216 as governed by the controller 1010, such as in accordance with image data corresponding to the image to be formed on the media 216. When the current swath has had fluid ejected thereon in the desired manner, the media 216 is advanced in the direction indicated by the arrow 1008, so that the next swath of the media 216 is incident to the fluid-ejection printheads 204. The carriage 1012 again moves back and forth as indicated by the arrows 1006, and the fluid-ejection printheads 204 eject fluid onto this swath of the media 216 as the printheads 204 move on the carriage 1012.

As fluid is ejected by the fluid-ejection printheads 204, the sensing mechanism 416 of the intermediate fluid supply 210 detects the decreasing volume of fluid therewithin, such as by detecting the decreasing amount of pressure within the intermediate fluid supply 210. When the pressure within the intermediate fluid supply 210 drops to the threshold level 504 of FIG. 5, it can be said that the volume of the fluid currently stored within the intermediate fluid supply 210 has dropped to a first corresponding threshold value. Responsive to the sensing mechanism 416 detecting that the volume of the fluid within the intermediate fluid supply 210 has dropped to this first threshold value, the controller 1010 causes the pump 1004 to turn on to start replenishing the intermediate fluid supply 210. In this respect, then, the pump 1004 pumps fluid from the primary fluid supply 202 to the intermediate fluid supply 210, specifically to the reservoir 414 of the intermediate fluid supply 210.

As the intermediate fluid supply 210 is replenished with fluid from the primary fluid supply 202, the pressure within the intermediate fluid supply 210 increases to the original level 308 of FIG. 5. It can thus be said that the volume of the fluid currently stored within the intermediate fluid supply 210 has risen to a second corresponding threshold value. Responsive to the sensing mechanism 416 detecting that the volume of the fluid within the intermediate fluid supply 210 has risen to this second threshold value, the controller 1010 causes the pump 1004 to turn off to stop pumping fluid from the primary fluid supply 202 to the intermediate fluid supply 210. The second threshold value of fluid volume is greater than the first threshold value of fluid volume, corresponding to the level 308 of FIG. 5 being greater than the threshold level 504 of FIG. 5.

Figure 11:
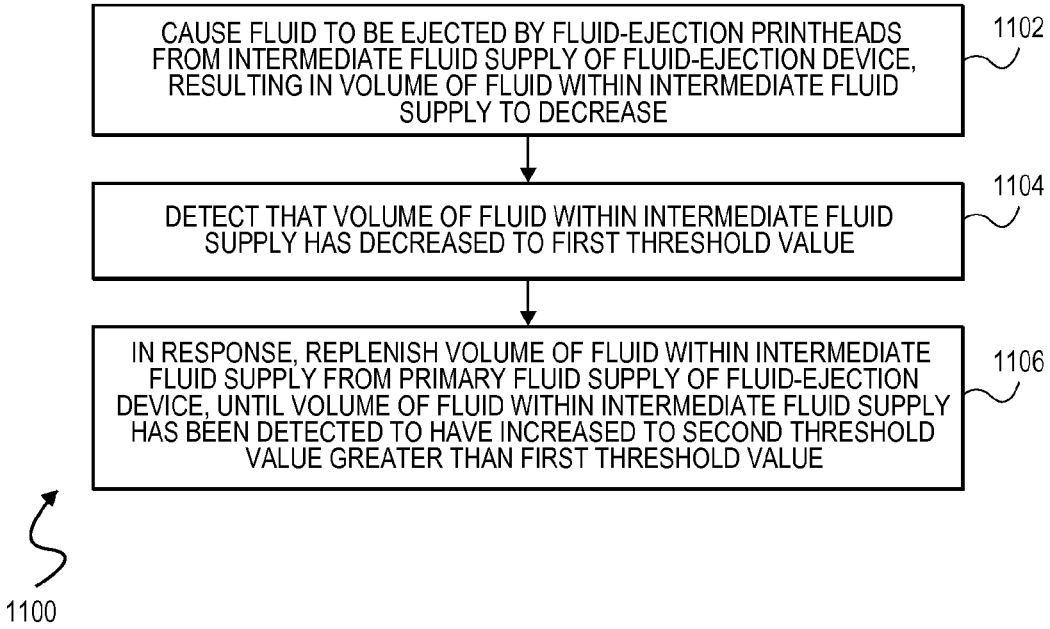
FIG. 11 is a flowchart of a method, according to an embodiment of the disclosure.

In conclusion, FIG. 11 shows a method 1100 that summarizes the operation of the fluid-ejection device 200 that includes the intermediate fluid supply 210 that has been described, according to an embodiment of the present disclosure. The controller 1010 causes fluid to be ejected by the fluid-ejection printheads 204 from the intermediate fluid supply 210, resulting in the volume of fluid within the reservoir 414 of the intermediate fluid supply 210 to decrease (1102). It is noted that the flexible membranes 408 and 602 of the intermediate fluid supply 210 decrease the rate of pressure decline within the intermediate fluid supply 210 resulting from the volume of the fluid decreasing within the reservoir 414.

The sensing mechanism 416 of the intermediate fluid supply 210 directly or indirectly detects that the volume of fluid within the reservoir 414 of the intermediate fluid supply 210 has decreased to a first threshold value (1104), corresponding to the pressure threshold level 504 of FIG. 5. In response, the controller 1010 turns on the pump 1004 to cause the pump 1004 to pump fluid from the primary fluid supply 202 to the intermediate fluid supply 210, replenishing the volume of fluid within the reservoir 414 of the intermediate fluid supply 210 (1106). Replenishment via pumping is continued until the sensing mechanism 416 has directly or indirectly detected that the volume of fluid within the reservoir 414 has increased to a second threshold value, which can be equal to or less than the pressure level 308 of FIG. 5, but which is greater than the first threshold value. At this time the controller 1010 turns off the pump 1004 to stop pumping fluid from the primary fluid supply 202 to the intermediate fluid supply 210.

The replenishment of the volume of fluid within the reservoir 414 of the intermediate fluid supply 210 in part 1106 of the method 1100 at least substantially prevents fluid starvation of the fluid-ejection printheads 204. Such fluid starvation would otherwise result if the volume of the fluid within the reservoir 414 were permitted to further decrease to a third threshold value (corresponding to the pressure threshold level 304 of FIGS. 3 and 5) less than the first threshold value (corresponding to the pressure threshold level 504 of FIG. 5). In such ways, then, the fluid-ejection device 100, including the intermediate fluid supply 210 having the sensing mechanism 416 and at least the flexible membrane 408, overcomes the problems that have been discussed towards the beginning of the detailed description.

It is finally noted that the fluid-ejection device 200 as depicted in FIG. 10 is just one exemplary topology of such a fluid-ejection device, in which both the media 216 and the fluid-ejection printhead 216 move. In another embodiment, the media 216 may be stationary, and the fluid-ejection printhead 216 may be able to move back and forth along the axis indicated by the arrows 1006 as well as back and forth along the axis indicated by the arrow 1008. In still another embodiment, the printheads 216 may be stationary, and just the media 216 may move. For instance, in a page-wide array fluid-ejection device, there may be a number of printheads 204 spanning the media 216 from the edge 1018 to the edge 1020. As such, these fluid-ejection printheads 204 eject fluid onto the media 216 as the media 216 moves under the printheads 204 in the direction indicated by the arrow 1008.

The invention claimed is:

1. An intermediate fluid supply apparatus to fluidically couple a primary fluid supply to one or more fluid-ejection printheads, comprising:

a reservoir having a bottom surface and a plurality of side surfaces and open at a top of the reservoir, to store fluid supplied by the primary fluid supply for ejection by the fluid-ejection printheads;

a flexible membrane sealing the top of the reservoir and parallel to an imaging surface onto which the fluid-ejection printheads are to eject the fluid, the flexible membrane to expand and contract over the reservoir in accordance with a volume of the fluid currently stored within the reservoir; and, a sensing mechanism to sense directly or indirectly the volume of the fluid currently stored within the reservoir, wherein the flexible membrane is to expand and contract over the reservoir unassisted by any other component of the intermediate fluid supply apparatus, and the flexible membrane is connected within the intermediate fluid supply apparatus just to the side surfaces of the reservoir.

2. The intermediate fluid supply apparatus of claim 1, wherein the reservoir comprises a pair of side cavities located at short sides of the reservoir along an axis of movement of the intermediate fluid supply apparatus, the bottom of the reservoir having a pair of openings corresponding to the side cavities, wherein the intermediate fluid supply apparatus further comprises a pair of secondary flexible membranes sealing the openings at the bottom of the reservoir leading to the side cavities of the reservoir, and wherein the secondary flexible membranes are to expand and contract under the reservoir in accordance with changing volumes of the fluid currently located within the cavities due to movement of the intermediate fluid supply apparatus.

3. The intermediate fluid supply apparatus of claim 2, further comprising a plurality of partitions located within the reservoir to define the side cavities and to define a plurality of fluid channels perpendicular to a long side of the intermediate fluid supply apparatus, wherein the partitions run perpendicular to the axis of movement, and each partition comprises a fluid passageway therethrough to fluidically couple the fluid channels with one another.

4. The intermediate fluid supply apparatus of claim 2, further comprising a pair of rigid bottoms attached to the bottom of the reservoir over the secondary flexible membranes to protect the secondary flexible membranes, the rigid bottoms having a plurality of holes to expose bottoms of the secondary flexible membranes to ambient pressure.

5. The intermediate fluid supply apparatus of claim 1, further comprising a rigid top attached to the top of the reservoir over the flexible membrane to protect the flexible membrane, the rigid top having one or more holes to expose a top of the flexible membrane to ambient pressure.

6. The intermediate fluid supply apparatus of claim 1, further comprising:

one or more fluid inlets fluidically coupled to the reservoir along a first long side of the reservoir to supply fluid into the reservoir from the primary fluid supply;

one or more fluid outlets fluidically coupled to the reservoir along short sides of the reservoir to drain fluid from the reservoir; and, one or more fluid ports fluidically coupled to the reservoir along a second long side of the reservoir to supply fluid to the fluid-ejection printheads.

7. The intermediate fluid supply apparatus of claim 1, wherein an interior of reservoir comprises a plurality of corners at which the side surfaces and the bottom surface meet, the corners being rounded and not sharp to at least substantially inhibit gaseous bubbles from becoming lodged at the corners.

8. The intermediate fluid supply apparatus of claim 1, wherein the flexible membrane is to contract as the volume of fluid currently stored within the reservoir decreases due to ejection of the fluid by the fluid-ejection printheads, and wherein the flexible membrane is to expand as the volume of fluid currently stored within the reservoir increases due to pumping of the fluid from the primary fluid supply into the reservoir.

9. The intermediate fluid supply apparatus of claim 1, wherein the sensing mechanism comprises one of:

a fluid volume sensor to directly sense the volume of the fluid currently stored within the reservoir; and, a pressure sensor to indirectly sense the volume of the fluid currently stored within the reservoir by directly sensing the pressure inside the reservoir.

10. A fluid-ejection device comprising:

a primary fluid supply to store fluid;

one or more fluid-ejection printheads to eject the fluid in a desired manner; and, an intermediate fluid supply apparatus to fluidically couple the primary fluid supply to the fluid-ejection printheads, the fluid ejected by the fluid-ejection printheads received from primary fluid supply via the intermediate fluid supply apparatus, the intermediate fluid supply apparatus comprising:

a reservoir having a bottom surface and a plurality of side surfaces and open at a top of the reservoir, to store fluid supplied by the primary fluid supply for ejection by the fluid-ejection printheads;

a flexible membrane sealing the top of the reservoir and parallel to an imaging surface onto which the fluid-ejection printheads are to eject the fluid, the flexible membrane to expand and contract over the reservoir in accordance with a volume of the fluid currently stored within the reservoir; and, a sensing mechanism to sense directly or indirectly the volume of the fluid currently stored within the reservoir, wherein the flexible membrane is to expand and contract over the reservoir unassisted by any other component of the intermediate fluid supply apparatus, and the flexible membrane is connected within the intermediate fluid supply apparatus just to the side surfaces of the reservoir.

11. The fluid-ejection device of claim 10, wherein along a z-axis, the intermediate fluid supply is located above the fluid-ejection printheads.

12. The fluid-ejection device of claim 10, wherein the reservoir comprises a pair of side cavities located at short sides of the reservoir along an axis of movement of the intermediate fluid supply apparatus, the bottom of the reservoir having a pair of openings corresponding to the side cavities, wherein the intermediate fluid supply apparatus further comprises a pair of secondary flexible membranes sealing the openings at the bottom of the reservoir leading to the side cavities of the reservoir, and wherein the secondary flexible membranes are to expand and contract under the reservoir in accordance with changing volumes of the fluid currently located within the cavities due to movement of the intermediate fluid supply apparatus.

13. A method comprising:

causing fluid to be ejected by one or more fluid-ejection printheads of a fluid-ejection device from an intermediate fluid supply apparatus of the fluid-ejection device, resulting in a volume of the fluid within the intermediate fluid supply apparatus to decrease, wherein one or more flexible membranes of the intermediate fluid supply apparatus and are parallel to an imaging surface onto which the fluid-ejection printheads are to eject the fluid and seal a reservoir of the intermediate fluid supply apparatus to decrease a rate of pressure decline within the intermediate fluid supply apparatus resulting from the volume of the fluid within the intermediate fluid supply apparatus decreasing, wherein the flexible membranes are each to expand and contract over the reservoir in accordance with a volume of the fluid currently stored within the reservoir in a manner unassisted by any other component of the intermediate fluid supply apparatus and the flexible membranes are each connected within the intermediate fluid supply apparatus just to surfaces of the reservoir non-parallel to the imaging surface.

14. The method of claim 13, further comprising:

in response to detecting that the volume of the fluid within the intermediate fluid supply apparatus has decreased to a first threshold value, replenishing the volume of the fluid within the intermediate fluid supply apparatus from a primary fluid supply of the fluid-ejection device, until the volume of the fluid within the intermediate fluid supply apparatus has been detected to have increased to a second threshold value greater than the first threshold value.

15. The method of claim 14, wherein replenishing the volume of the fluid within the intermediate fluid supply in response to detecting that the volume of the fluid has decreased to the first threshold value prevents fluid starvation of the fluid-ejection printheads that would otherwise result where the volume of the fluid within the intermediate fluid supply further decreases to a third threshold value less than the first threshold value.

* * * * *